US006701763B2

(12) United States Patent
Varela

(10) Patent No.: US 6,701,763 B2
(45) Date of Patent: Mar. 9, 2004

(54) HYDROFORMED AXLE WITH WELDLESS BRAKE FLANGE AND BEARING SHOULDER

(75) Inventor: Tomaz Dopico Varela, Gahanna, OH (US)

(73) Assignee: Meritor Heavy Vehicle Technology, Troy, MI (US)

( * ) Notice: Subject to any disclaimer, the term of this patent is extended or adjusted under 35 U.S.C. 154(b) by 116 days.

(21) Appl. No.: 09/940,106

(22) Filed: Aug. 27, 2001

(65) Prior Publication Data

US 2003/0057764 A1 Mar. 27, 2003

(51) Int. Cl.[7] ..... B21D 39/20

(52) U.S. Cl. ..... 72/61; 301/124.1; 29/421.1; 72/370.22

(58) Field of Search ..... 301/124.1, 125, 301/126, 131; 29/897.2, 421.1; 72/60–62, 370.22, 370.23, 370.24, 370.25

(56) References Cited

U.S. PATENT DOCUMENTS 4,363,522 A * 12/1982 Palovcik ..... 301/131
5,107,693 A * 4/1992 Olszewski et al. ..... 72/58
5,641,176 A 6/1997 Alatalo
5,673,929 A 10/1997 Alatalo
5,718,048 A * 2/1998 Horton et al. ..... 29/897.2
5,720,092 A 2/1998 Ni et al.
5,899,498 A 5/1999 Horton
6,006,568 A * 12/1999 Bihrer ..... 72/60
6,015,182 A 1/2000 Weissert et al.
6,059,378 A * 5/2000 Dougherty et al. ..... 301/124.1
6,120,059 A 9/2000 Beckman
6,122,948 A * 9/2000 Moses ..... 72/61
6,170,309 B1 1/2001 Marando
6,234,375 B1 5/2001 Durand
6,484,384 B1 * 11/2002 Gibson et al. ..... 29/516
6,487,886 B2 * 12/2002 Ueno et al. ..... 72/57
6,513,243 B1 * 2/2003 Bignucolo et al. ..... 29/897.2
6,547,267 B1 * 4/2003 Heep ..... 280/124.128
6,572,199 B1 * 6/2003 Creek et al. ..... 301/124.1

* cited by examiner

*Primary Examiner*—Russell D. Stormer
(74) *Attorney, Agent, or Firm*—Carlson, Gaskey & Olds

(57) ABSTRACT

An axle assembly is provided that includes a tubular member having an outer wall and an interior cavity. The other wall includes a first interlocking feature. An axle component mounting member, such as a bearing shoulder sleeve and/or a brake flange, is arranged on a portion of the outer wall. The mounting member includes a second interlocking feature coacting with the first interlocking feature to affix the mounting member and tubular member to one anther. The axle assembly may be formed by arranging the axle mounting member into a die assembly. A tubular member may be arranged in the die assembly within an opening in the mounting member. A hydroforming process may be employed to pressurize a cavity within the tubular member. A portion of the tubular member is deformed into engagement with the mounting member to affix the mounting member to the tubular member.

10 Claims, 2 Drawing Sheets

HYDROFORMED AXLE WITH WELDLESS BRAKE FLANGE AND BEARING SHOULDER

BACKGROUND OF THE INVENTION

This invention relates to an axle assembly, and more particularly, the invention relates to a hydroformed axle with a bearing shoulder and brake flange that are secured thereto preferably without the use of welds.

Many prior art axle assemblies, such as for use in trucks or trailers, are constructed from tubes or solid members that are straight or bent to a desired shape. Numerous components are typically secured to the axle, typically by welding the axle component to the axle. For example, the brake assembly is supported on the axle by a brake flange, which is welded to the axle. Welding components to the axle requires that a consumable welding material be deposited on the brake component axle in a relatively precise manner. As a result, the welding process may be expensive and difficult to control.

The wheels are supported on the ends of the axle on bearing assemblies. Bearing races are pressed onto the axle to abut a shoulder, which may be machined onto the axle, to locate the bearings axially. Machining can be a relatively expensive process therefore, what is needed is an axle assembly on which a bearing shoulder may be provided and to which a brake flange may be secured to without the use of expensive machining or welding.

SUMMARY OF THE INVENTION AND ADVANTAGES

The present invention provides an axle assembly including a tubular member having an outer wall and an interior cavity. The other wall includes a first interlocking feature. An axle component mounting member, such as a bearing shoulder sleeve and/or a brake flange, is arranged on a portion of the outer wall. The mounting member includes a second interlocking feature coacting with the first interlocking feature to affix the mounting member and tubular member to one anther. The axle assembly may be formed by arranging the axle mounting member into a die assembly. A tubular member may be arranged in the die assembly within an opening in the mounting member. A hydroforming process may be employed to pressurize a cavity within the tubular member. A portion of the tubular member is deformed into engagement with the mounting member to affix the mounting member to the tubular member.

Accordingly, the above invention provides an axle assembly on which a bearing shoulder may be provided and to which a brake flange may be secured to without the use of expensive machining or welding.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
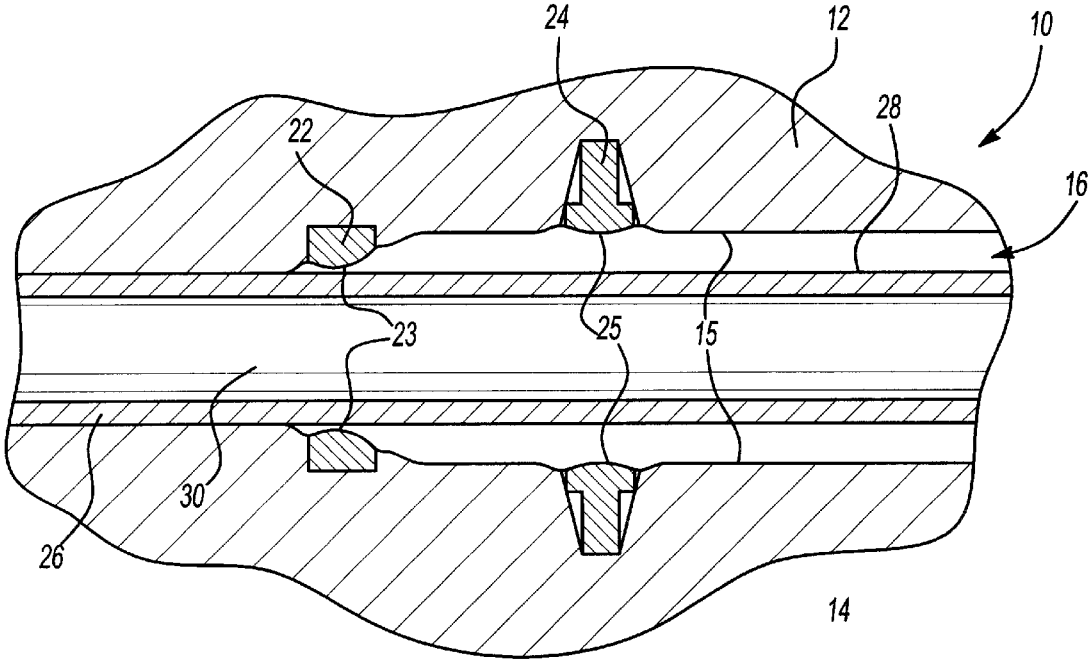
FIG. 1 is a cross sectional view of a tubular member and axle component mounting member within a die assembly forming the axle assembly of the present invention.
Figure 2:
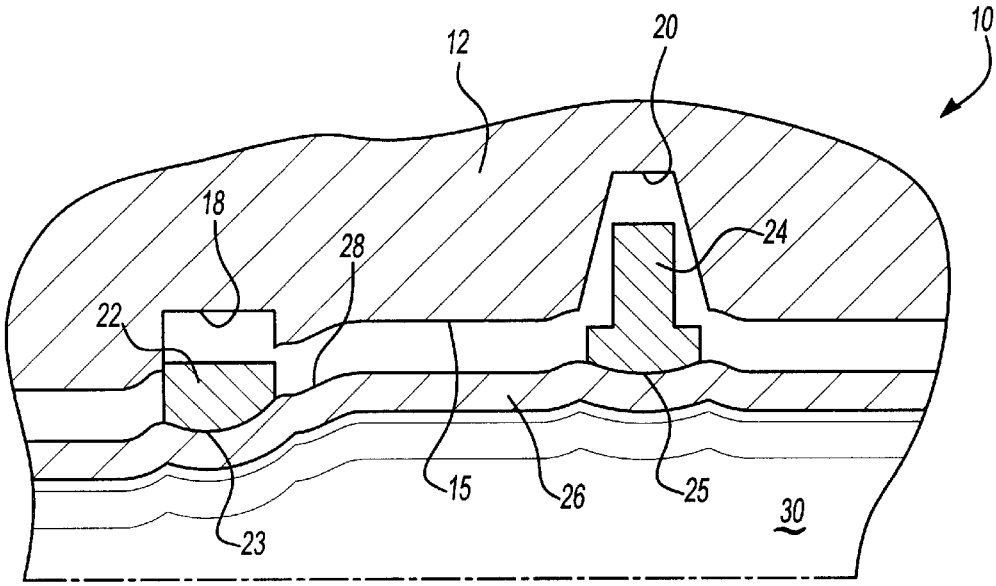
FIG. 2 is an enlarged view of the axle assembly of the present invention subsequent to forming.
Figure 3:
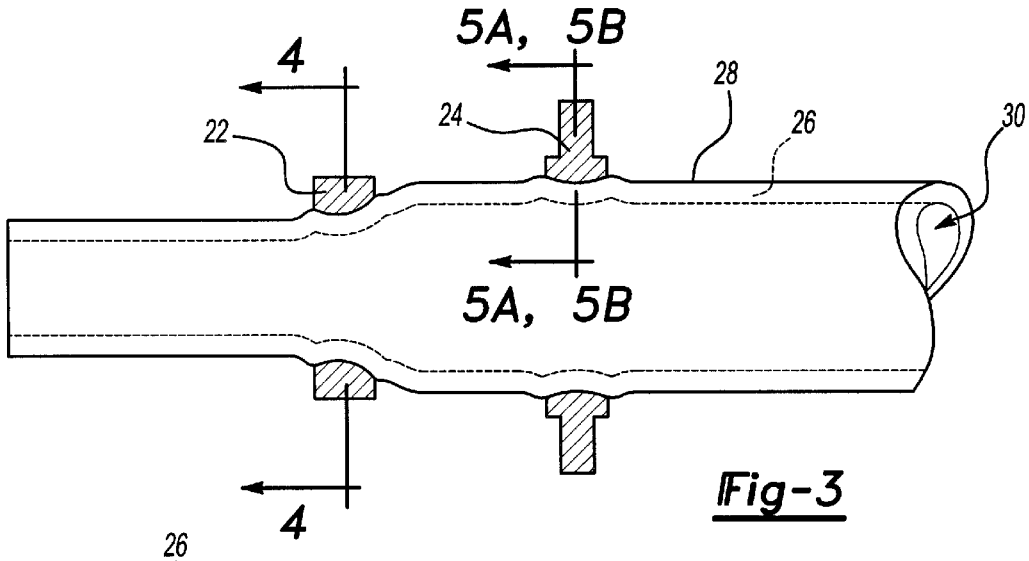
FIG. 3 is a side elevational view of a bearing shoulder sleeve and brake flange secured to the tubular member by the present invention axle forming process.

The die assembly 10 is shown in FIGS. 1 and 2 and includes first 12 and second 14 die portions. Together the die portions 12 and 14 provide a forming surface 15 that defines the shape of the axle assembly to be formed. The die portions 12 and 14 include mounting member receptacles 18 and 20 within the forming cavity 16 of the die assembly 10. A bearing shoulder sleeve 22 may be arranged in one of the receptacles 18, and a brake flange 24 may be arranged in the other receptacle 20. The bearing shoulder sleeve 22 provides a shoulder against which bearing assemblies may be installed. The brake flange 24 provides a mount to which a brake assembly for the wheel may be secured.

The bearing shoulder sleeve 22 and brake flange 24 respectively include openings 23 and 25. A tubular member 26 is inserted into the forming cavity 16 and is arranged within the openings 23 and 25. The tubular member 26 includes an outer wall 28 and an interior cavity 30. Utilizing a known hydroforming process, the cavity 30 is pressurized with the hydraulic fluid to force the outer wall 28 into engagement with the forming surface 15 of the die portions 12 and 14. The outer wall 28 is deformed such that it engages the openings 23 and 25. Preferably, the openings 23 and 25 of the mounting members include a generally concaved annular surface such that the deformed outer wall 28 of the tubular member 26 locates the mounting members 22 and 24 axially on the tubular member 26.

Figure 5A:
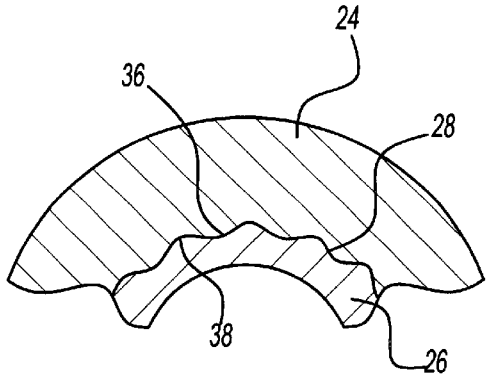
FIG. 5A is a partial cross-sectional view of one embodiment of the interlocking features taken along line 5—5 of FIG. 3.
Figure 5B:
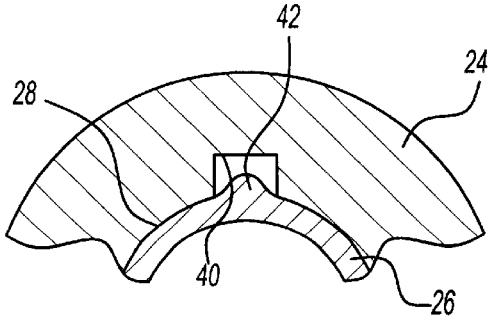
FIG. 5B is a partial cross-sectional view of another embodiment of the interlocking features taken along line 5—5 of FIG. 3.

The tubular member 26 and mounting members 22 and 24 may respectively include first 36 and second 38 interlocking features. For example, the interlocking features may be complementary and recesses or splines, as shown in FIG. 5A. Alternatively, the mounting member may include a hole 40 that receives a protrusion 42 formed during the hydroforming process. The interlocking features 36 and 38 ensure that the mounting members 22 and 24 do not move axially or rotationally relative to the tubular member 26.

Figure 4:
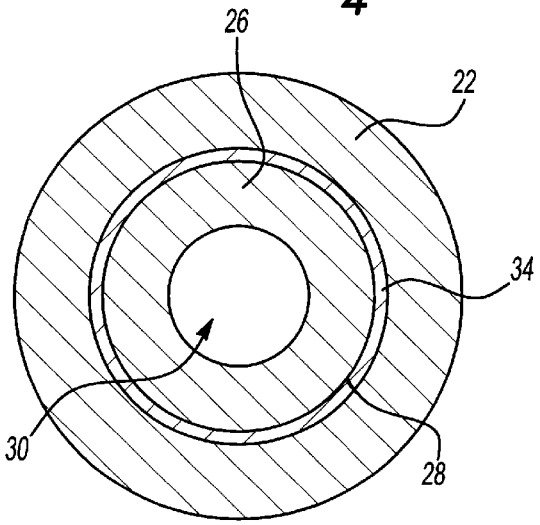
FIG. 4 is a cross-sectional view of the bearing shoulder sleeve taken along lines 4—4 of FIG. 3.

Referring to FIG. 4, a material 34 such as a polymeric film or adhesive may be arranged between the mounting members 22 and 24 and the tubular member 26 to prevent corrosion. The material 34 may be selected such that a seal is created between the bearing shoulder sleeve 22 and the tubular member 26 to prevent leakage of lubricant past the bearing shoulder sleeve 22.

In this manner, a shoulder for the bearing assembly may be provided without machining the axle. Moreover, the brake flange 24 may be secured to the axle without welding. Post heat treatment of the axle assembly may not be necessary with the present invention hydroforming process.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A method of forming an axle comprising the steps of:

a) arranging an axle component mounting member into a die assembly;

b) arranging a tubular member in the die assembly within an opening in the mounting member;

c) pressurizing a cavity within the tubular member; and d) deforming a portion the tubular member into engagement with mounting member to affix the mounting member to the tubular member.

2. The method according to claim 1, wherein the mounting member is a bearing shoulder sleeve.

3. The method according to claim 1, wherein the mounting member is a brake flange.

4. The method according to claim 1, further including the step of arranging a material between the mounting component and the tubular member for preventing corrosion therebetween.

5. The method according to claim 1, wherein the mounting member includes a recess, and step d) includes deforming a portion of the tubular member into the recess.

6. The method according to claim 5, wherein the recess is at least one hole.

7. The method according to claim 5, wherein the recess is defined by a splined surface arranged about the tubular member.

8. The method according to claim 1, further including the step of hydroforming the tubular member into a desired axle shape.

9. The method according to claim 1, wherein the opening of the mounting member is defined by a generally concave surface.

10. Tho method according to claim 1, wherein step (d) is performed in response to performing step (c).

* * * * *

UNITED STATES PATENT AND TRADEMARK OFFICE

CERTIFICATE OF CORRECTION

PATENT NO. : 6,701,763 B2
DATED : March 9, 2004
INVENTOR(S) : Varela

It is certified that error appears in the above-identified patent and that said Letters Patent is hereby corrected as shown below:

Title page,
Item [73], Assignee, should read as follows:

-- [73] Assignee: Meritor Heavy Vehicle Technology, LLC, Troy, MI (US) --

Signed and Sealed this

Ninth Day of November, 2004

JON W. DUDAS
*Director of the United States Patent and Trademark Office*